US005801511A

United States Patent [19]

Kyushima et al.

[11] Patent Number: 5,801,511

[45] Date of Patent: *Sep. 1, 1998

[54] PHOTOMULTIPLIER

[75] Inventors: Hiroyuki Kyushima; Yutaka Hasegawa; Akira Atsumi; Koji Nagura, all of Hamamatsu, Japan

[73] Assignee: Hamamatsu Photonics K.K., Hamamatsu, Japan

[ * ] Notice: The term of this patent shall not extend beyond the expiration date of Pat. Nos. 5,491,380; 5,510,674; 5,498,926; 5,532,551; and 5,572,089.

[21] Appl. No.: 899,634

[22] Filed: Jul. 24, 1997

Related U.S. Application Data

[63] Continuation of Ser. No. 463,524, Jun. 5, 1995, abandoned.

[30] Foreign Application Priority Data

Jun. 6, 1994 [JP] Japan ..... 6-123786

[51] Int. Cl.[6] ..... H01J 43/06

[52] U.S. Cl. ..... 313/532; 313/533; 313/103 CM; 313/105 CM

[58] Field of Search ..... 313/533, 534, 313/535, 536, 527, 528, 530, 540, 542, 103 R, 103 CM, 105 R, 377, 378, 379, 383, 387, 390, 399, 238, 268, 281, 292

[56] References Cited

U.S. PATENT DOCUMENTS

| | | | |
|---|---|---|---|
| 3,229,143 | 1/1966 | Bartschat | 313/105 |
| 3,474,276 | 10/1969 | Betoule et al. | 313/103 CM |
| 3,513,345 | 5/1970 | Feaster | 313/533 X |
| 4,023,093 | 5/1977 | King et al. | 313/103 CM |
| 4,395,437 | 7/1983 | Knapp | 427/78 |
| 4,626,736 | 12/1986 | Mansell | 313/105 CM |
| 4,649,314 | 3/1987 | Eschard | 313/103 CM |
| 4,721,880 | 1/1988 | Mansell et al. | 313/105 CM |
| 5,220,240 | 6/1993 | Ohoshi et al. | 313/103 R X |
| 5,491,380 | 2/1996 | Kyushima et al. | 313/533 |
| 5,498,926 | 3/1996 | Kyushima et al. | 313/533 |
| 5,510,674 | 4/1996 | Kyushima et al. | 313/533 |
| 5,532,551 | 7/1996 | Kyushima et al. | 313/533 |
| 5,572,089 | 11/1996 | Kyushima et al. | 313/533 |

FOREIGN PATENT DOCUMENTS

| | | |
|---|---|---|
| 0 068 600 | 1/1983 | European Pat. Off. . |
| 0 423 886 | 4/1991 | European Pat. Off. . |
| 0 622 826 | 11/1994 | European Pat. Off. . |
| 60-39752 | 3/1985 | Japan . |
| 60-182642 | 9/1985 | Japan . |
| 62-41378 | 9/1987 | Japan . |
| 3-147240 | 6/1991 | Japan . |

OTHER PUBLICATIONS

Fujii, Y., et al., Surface Analysis of Cu–Be Dynode, J. Vac. Sci. Technol., 17(5), Sep./Oct. 1980, pp. 1221–1224.

Engstrom, Ralph W., Photomultiplier Handbook, 1980, pp. 1–5.

*Primary Examiner*—Ashok Patel

*Attorney, Agent, or Firm*—Cushman Darby & Cushman IP Group of Pillsbury Madison & Sutro LLP

[57] ABSTRACT

A photomultiplier of the present invention has an electron multiplier of a structure which can be manufactured easily. This electron multiplier is constituted by dynode plates that are stacked through insulators so as to be separated from each other at a predetermined interval. Each dynode plate comprises upper- and lower-electrode plates that are electrically connected to each other. The upper- and lower-electrode plates grip at least one of the insulators such that the gripped insulator is partly exposed.

28 Claims, 12 Drawing Sheets

PHOTOMULTIPLIER

This is a continuation of application Ser. No. 08/463,524, filed on Jun. 5, 1995, which was abandoned upon the filing hereof.

BACKGROUND OF THE INVENTION

1. Field of the Invention

The present invention relates to an electron multiplier for cascade-multiplying an incident electron flow and ions, and a photomultiplier incorporating such an electron multiplier.

2. Related Background Art

The electron multiplying portion of an electron multiplier is constituted by stacking a plurality of dynodes in a plurality of stages at a predetermined gap. U.S. Pat. No. 3,229,143 discloses an arrangement in which an electron multiplying portion is constituted by stacking a plurality of metal plates supporting dynodes in a plurality of stages through insulating balls.

SUMMARY OF THE INVENTION

It is an object of the present invention to obtain the structure of an electron multiplier which decreases variations in gain at different portions on an incident surface on which an electron flow, ions, or the like is incident. It is well-known that the electron multiplier can be applied to a photomultiplier or the like.

This electron multiplier has at least a dynode unit and an anode. The dynode unit for cascade-multiplying the electron flow or the like is constituted by stacking metal plates each having a plurality of dynodes in the incident direction of the electron flow or the like. Spacers made of an insulating material are arranged among these plates. The interval between the plates adjacent to each other in the stacking direction is maintained at a predetermined value by the corresponding spacer. Part of each spacer is fitted in the opening of a through hole formed in the corresponding plate, so that the respective plates are in a direction perpendicular to the stacking direction.

The spacers and the plates supporting the dynodes are made of different materials and are independent members. Thus, sometimes the spacers may be shifted, among the plates, from positions where the openings of the corresponding through holes should be present, or the spacers may not be present among the plates. The spacers serve to maintain the gap among the dynode plates at a predetermined value. Hence, if the interval between the metal plates adjacent to each other in the stacking direction is not uniformly maintained at the respective portions of the metal plates, the gain differs depending on portions where the electron flow, ions, or the like is incident.

In order to achieve the above object, a photomultiplier according to the present invention comprises, as shown in FIG. 1, a photocathode (21), an anode plate (25), and a dynode unit (20) provided between the photocathode (21) and the anode plate (25). The dynode unit (20) has a plurality of dynode plates (24) which are stacked in a direction perpendicular to a major surface (251) of the anode plate (25) at a predetermined gap through insulators (spacers) (27) (see FIG. 16). The direction perpendicular to the major surface (251) of the anode plate (25) coincides with a stacking direction (31) of the dynode plates (24) (see FIGS. 2, 3, 4, 7, 16, and 17) and the incident direction of the electron flow or the like (see FIG. 11). The respective dynode plates (24) are electrically connected to metal pins (14) extending through the bottom portion of a vacuum vessel (10) into its interior where the dynode unit (20) is provided. Predetermined voltages are independently applied to the dynode plates (24) from an external power supply (200) through the metal pins (14). Then, the dynode plates (24) are set at appropriate potentials, respectively.

Particularly, as shown in FIG. 1, each dynode plate (24) supports at least one dynode (240) and has an upper-electrode plate (24*a*) and, as shown in FIGS. 2 and 17, a lower-electrode plate (24*b*) which is in tight contact with and electrically connected to the upper-electrode plate (24*a*) and grips the insulators (27) together with the upper-electrode plate (24*a*). FIG. 2 shows a case wherein each insulator (27) is spherical. FIG. 17 shows a case wherein each insulator (27) is a circular cylinder.

The upper-electrode plate (24*a*) has a first through hole (241) formed with a tapered portion (243) at its first upper-electrode surface ($24a_1$) that is of the upper-electrode plate and is in tight contact with the lower-electrode plate (24*b*). The first through hole (241) holds the corresponding insulator (27) and couples a second upper-electrode surface ($24a_2$) of the upper-electrode plate (24*a*) on the opposite side to the first upper-electrode surface ($24a_1$) with the tapered portion (243). The lower-electrode plate (24*b*) has a second through hole (242). The second through hole (242) couples a first lower-electrode surface ($24b_1$) that is of the lower-electrode plate and is in tight contact with the upper-electrode plate (24*a*) with a second lower-electrode surface ($24b_2$) on the opposite side to the first lower-electrode surface ($24b_1$), and holds the corresponding insulator (27). An area (S2 in FIG. 2 or S5 in FIG. 17) of an opening (242*a*) of the second through hole (242) located on the first lower-electrode surface side of the second through hole (242) is larger than an area (S3 in FIG. 2 or S6 in FIG. 17) of an opening (242*b*) of the second through hole (242) located on the second lower-electrode surface side of the second through hole (242).

In particular, the area (S2 or S5) of the opening (242*a*) of the second through hole (242) on the first lower-electrode surface side is larger than a maximum area (S1 in FIG. 2 or S4 in FIG. 17) of the section of the insulator (27), the section being in parallel to the major surface (251) of the anode plate (25). On the other hand, the area (S3 or S6) of the opening (242*b*) of the second through hole (242) located on the second lower-electrode surface side is smaller than the maximum area (S1 or S4) of the section of the insulator (27), the section being in parallel to the major surface (251) of the anode plate (25).

When each insulator (27) is spherical, as shown in FIG. 2, its section having the maximum area is a section including its center (270). When each insulator (27) is a circular cylinder, as shown in FIG. 17, its section having the maximum area is a section including its central axis (32). The central axis (32) of the circularly insulator (27) is in parallel to the major surface (251) of the anode plate (25).

Thus, an inner wall (242*c*) of the second through hole (242) is brought into contact with the corresponding insulator (27), and part of this insulator (27) projects from the opening (242*b*) of the second through hole (242) located on the second lower-electrode surface ($24b_2$). When part of this insulator (27) is gripped by the upper- and lower-electrode plates (24*a* and 24*b*), its center (270) (or the central axis (32) if the insulator (27) is a circular cylinder) is located between the first and second lower-electrode surfaces ($24b_1$ and $24b_2$) of the lower-electrode plate (24*b*), i.e., in a gap (T) shown in FIG. 4. The gap (T) corresponds to the thickness of the lower-electrode plate (24*b*).

The dynode unit (20) is obtained by stacking the dynode plates (24) each constituted by the upper- and lower-electrode plates (24*a* and 24*b*) gripping the corresponding insulator (27) in the above manner. When the dynode plates (24) are stacked, the insulators (27) adjacent to each other in the direction perpendicular to the major surface (251) of the anode plate (25) are brought into direct contact with each other. The adjacent insulators (27) are also in contact with the edges of the first through holes (241) formed in the upper-electrode plates (24*a*) (see FIG. 4).

From the above arrangement, the first through holes (241) formed in each upper-electrode plate (24*a*) realize alignment of the dynodes (240) supported by a dynode plate (24) located above this dynode plate (on the photocathode side). Since the insulators (27) adjacent to each other are in contact with respect to the major surface (251) of the anode plate (25), the respective insulators (27) transmit a structural pressure applied from the upper side (photocathode side) directly to the lower side (anode plate side). In other words, with this structure, the physical load applied to the dynode plates (24) gripping the insulators (27), e.g., the structural pressure that might cause fracture of the dynode plates (24), is decreased. Furthermore, when the upper- and lower-electrode plates (24*a* and 24*b*) are brought into tight contact with each other, each insulator (27) is accommodated in a space defined by a side wall (243*a*) of the tapered portion (243) and the inner wall (242*c*) of the second through hole (242) as it partly projects from the opening (242*b*) of the second through hole (242). Therefore, each of the insulators (27) gripped by the upper- and lower-electrode plates (24*a* and 24*b*) serves as the spacer that separates the respective dynode plates (24) from each other by a predetermined interval.

Since the spherical bodies are fixed by sandwiching them with the upper- and lower-electrode plates of the dynode plates, in the electron multiplier manufacturing process of stacking the plurality of dynode plates, the spherical bodies will not be shifted from the corresponding through holes. Thus, the gaps among the dynodes of the respective plates can be maintained at the predetermined value, so that variations in gain caused by the non-uniformity in the gap of the dynodes of the respective stage are decreased. In particular, when the plurality of dynode plates are stacked as in the conventional case, since the spherical bodies need not be arranged at predetermined portions on the dynode plates, the manufacture can be facilitated.

In the present invention, since part of each spherical body projecting from the corresponding through hole is abutted against the corresponding through hole of the adjacent dynode plate, the centers of the spherical bodies and the centers of the corresponding through holes, both continuous in the vertical direction, coincide with each other, thereby performing alignment of the dynode plates of the respective stages in the horizontal direction.

When the spherical bodies held by the adjacent dynode plates are abutted against each other, most of the power applied in the stacking direction (the direction perpendicular to the major surface of the anode plate) of the dynode plates acts on the series of spherical bodies, and an extra stress will not be applied to the respective plates.

The insulators described above can be insulating circular cylinders in place of spherical bodies. An operation which is substantially the same as that of the spherical bodies can be obtained with the circular cylinders.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The structure of a photomultiplier, and in particular an electron multiplier, according to the present invention will be described with reference to FIGS. 1 to 17.

Figure 1:
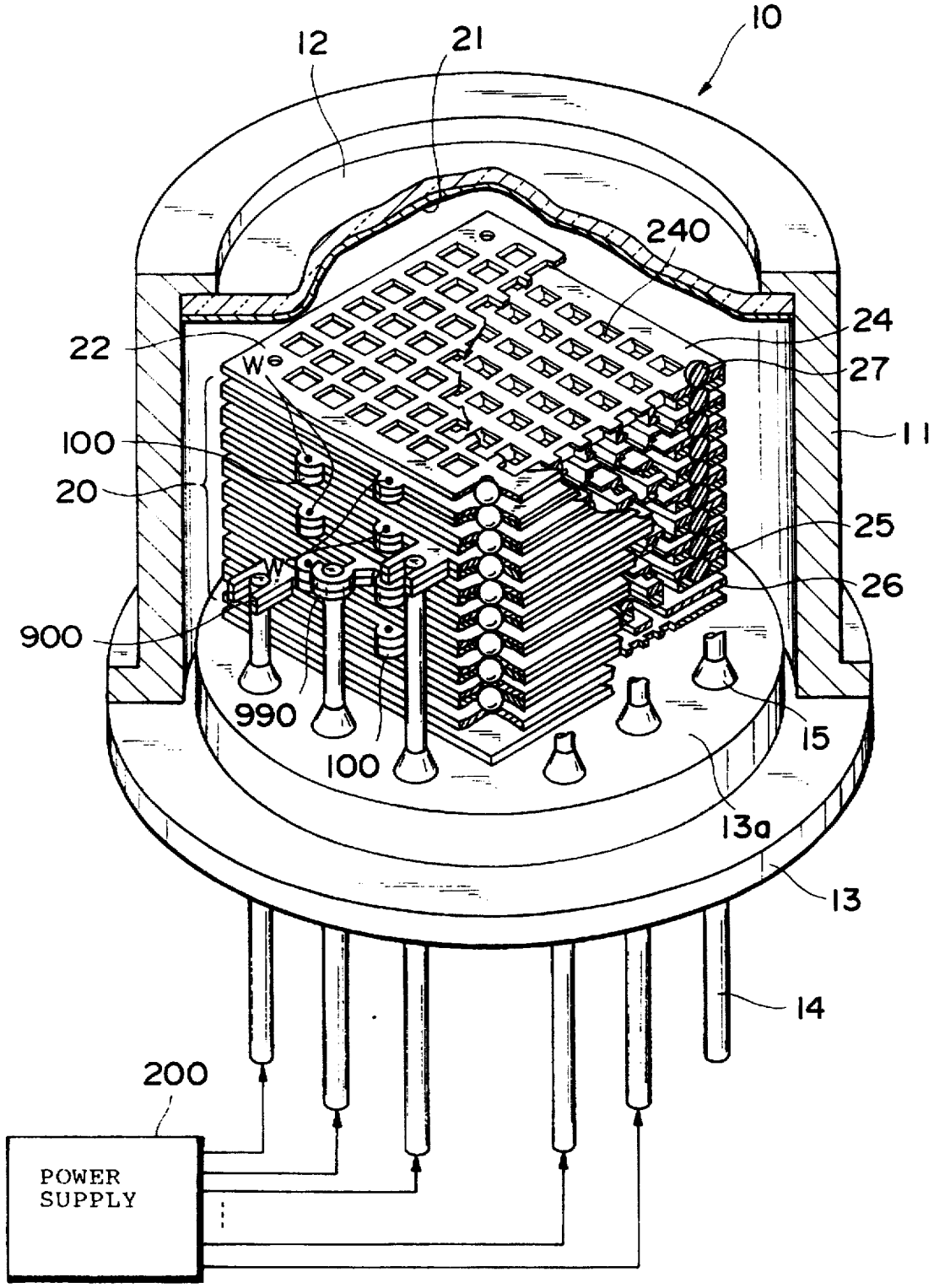
FIG. 1 is a perspective view showing the internal structure of a photomultiplier according to the present invention.

In order to achieve the above object, as shown in FIG. 1, the photomultiplier according to the present invention has, in a vacuum vessel 10, a photocathode 21, an anode plate 25 formed with a plurality of openings or through holes 250, and a dynode unit 20 provided between the photocathode 21 and the anode plate 25. The vacuum vessel 10 is hermetically formed with a metal side tube 11, a glass plate 12 mounted to one end of the metal side tube 11, and a circular stem 13 mounted to the other end of the metal side tube 11.

Furthermore, in the vacuum vessel 10, a focusing electrode plate 22 for correcting the orbit of photoelectrons emitted from the photocathode 21 is provided between the photocathode 21 and the dynode unit 20. A plurality of openings (focusing electrodes) 23 for passing the photoelectrons therethrough are formed in the focusing electrode plate 22, and are set at a higher potential than that of the photocathode 21. In this photomultiplier, a last-stage dynode plate 26 is provided between the anode plate 25 and a major surface 13*a* of the stem 13. The potential of the dynode plate 26 is set to be lower than or equal to that of the anode plate 25. The dynode plate 26 serves to emit secondary electrons toward the anode by receiving the secondary electrons emitted from the dynode unit 20 and passing through the openings 250 of the anode plate 25. Thus, the secondary electrons multiplied by the dynode unit 20 are captured efficiently by the anode.

Figure 16:
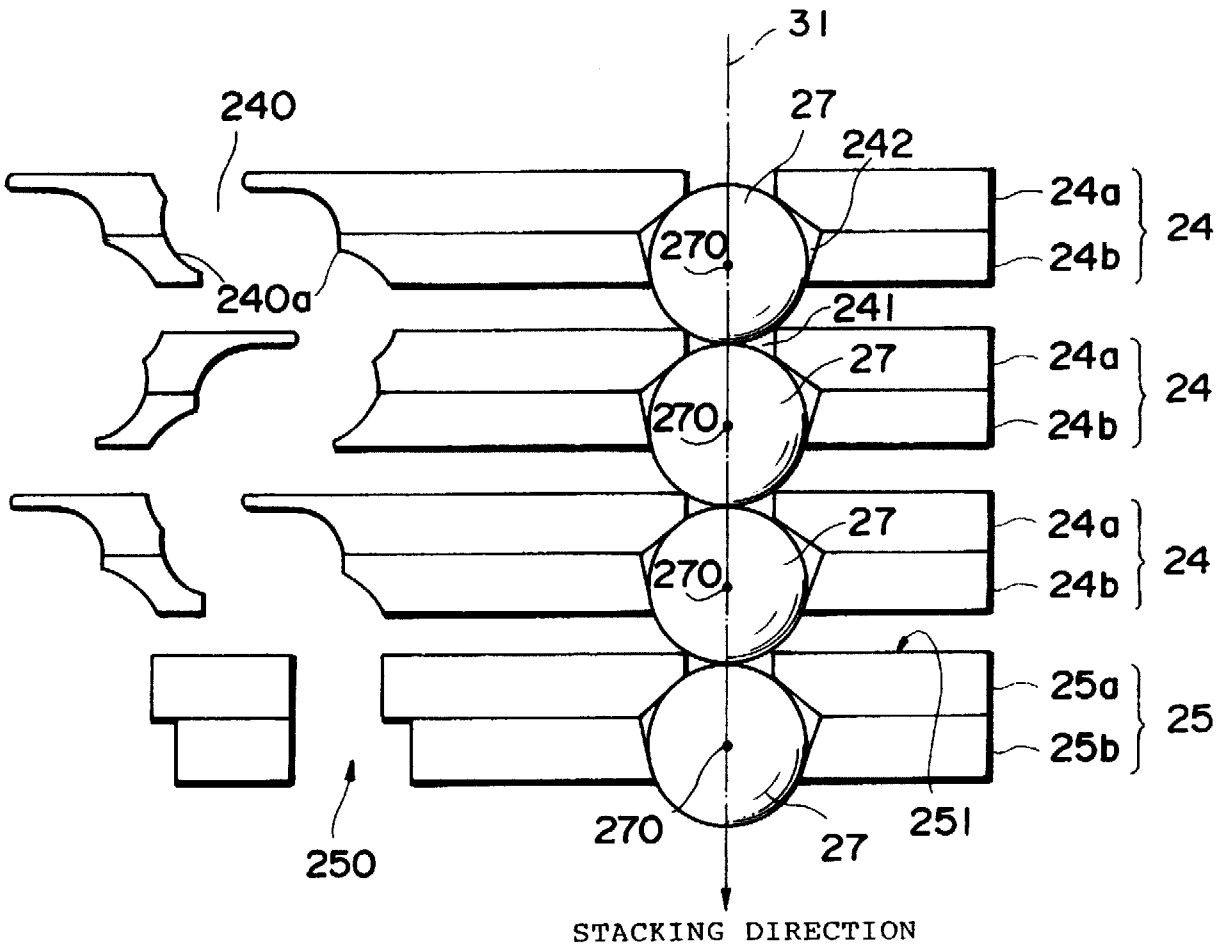
FIG. 16 is a sectional view showing the structure of the electron multiplier shown in FIG. 1.

The dynode unit 20 has a plurality of dynode plates 24 stacked in a direction perpendicular to the major surface 251 of the anode plate 25 such that they are spaced apart from each other by a predetermined gap through insulators (spacers) 27 (see FIG. 16). The direction perpendicular to the major surface 251 of the anode plate 25 coincides with a stacking direction 31 of the dynode plates 24 (see FIGS. 2, 3, 4, 7, 16, and 17) and the incident direction of the electron flow or the like (see FIG. 11).

The respective dynode plates 24 are electrically connected to connection pins 14 extending through the bottom portion (stem 13) of the vacuum vessel 10 into its interior where the dynode unit 20 is provided. The connection pins 14 are inserted in the vacuum vessel 10 perpendicularly to the major surface 13*a* of the stem 13, and are in direct electrical contact with the associated dynode plates 24. Predetermined voltages are independently applied from an external power supply 200 to the dynode plates 24 or the like through the connection pins 14. Thus, the plates 22, 24, 25, 26 are set at appropriate potentials, respectively.

The basic structure, operating principle, and material of the above photomultiplier are described in, e.g., U.S. Pat. No. 4,023,063, Japanese Patent Laid-Open Nos. 60-39752, 60-182642, 62-41378 and 3-147240, and RCA Photomultiplier Handbook.

Figure 2:
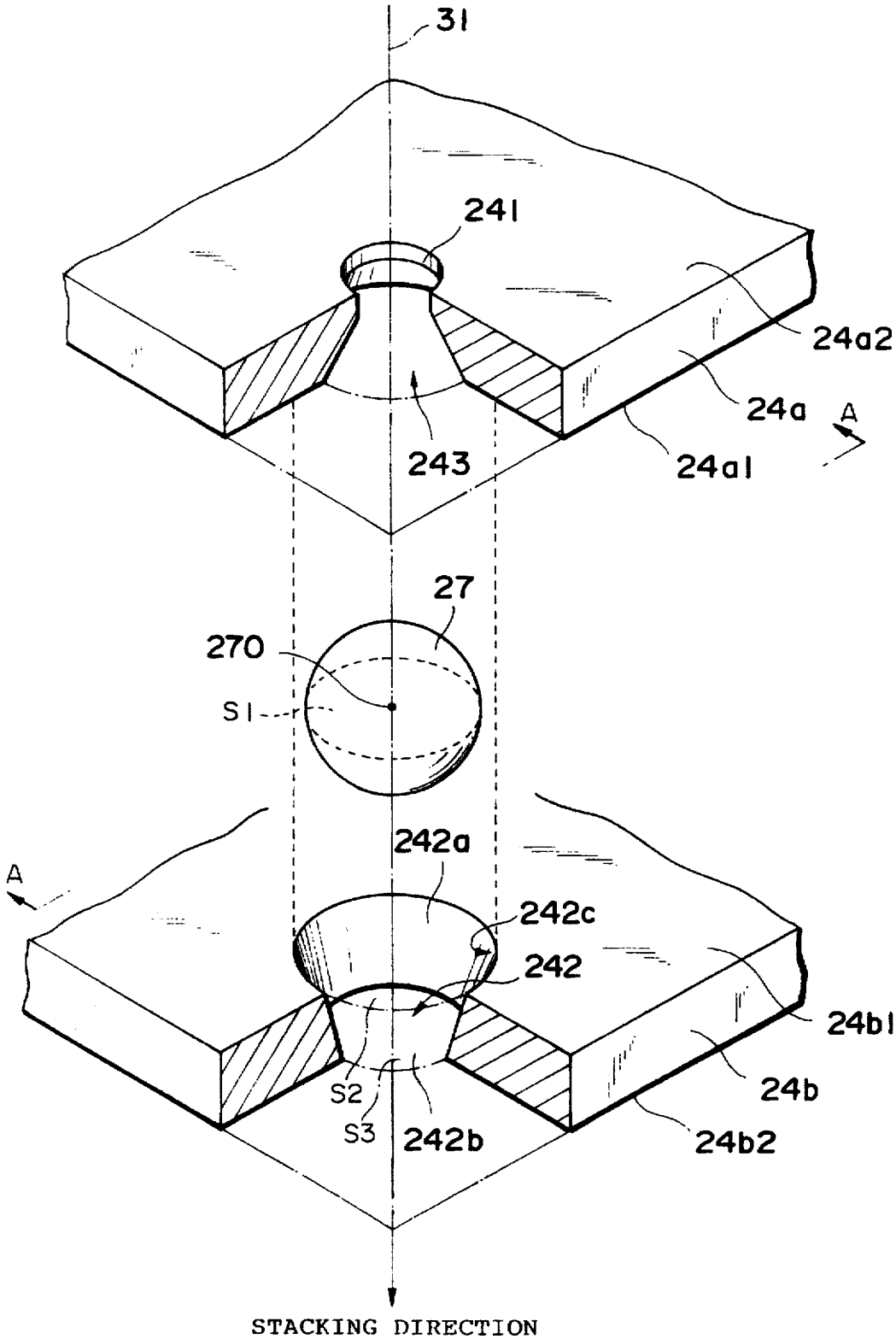
FIG. 2 is a perspective view showing the holding structure of an insulator of a dynode plate.
Figure 17:
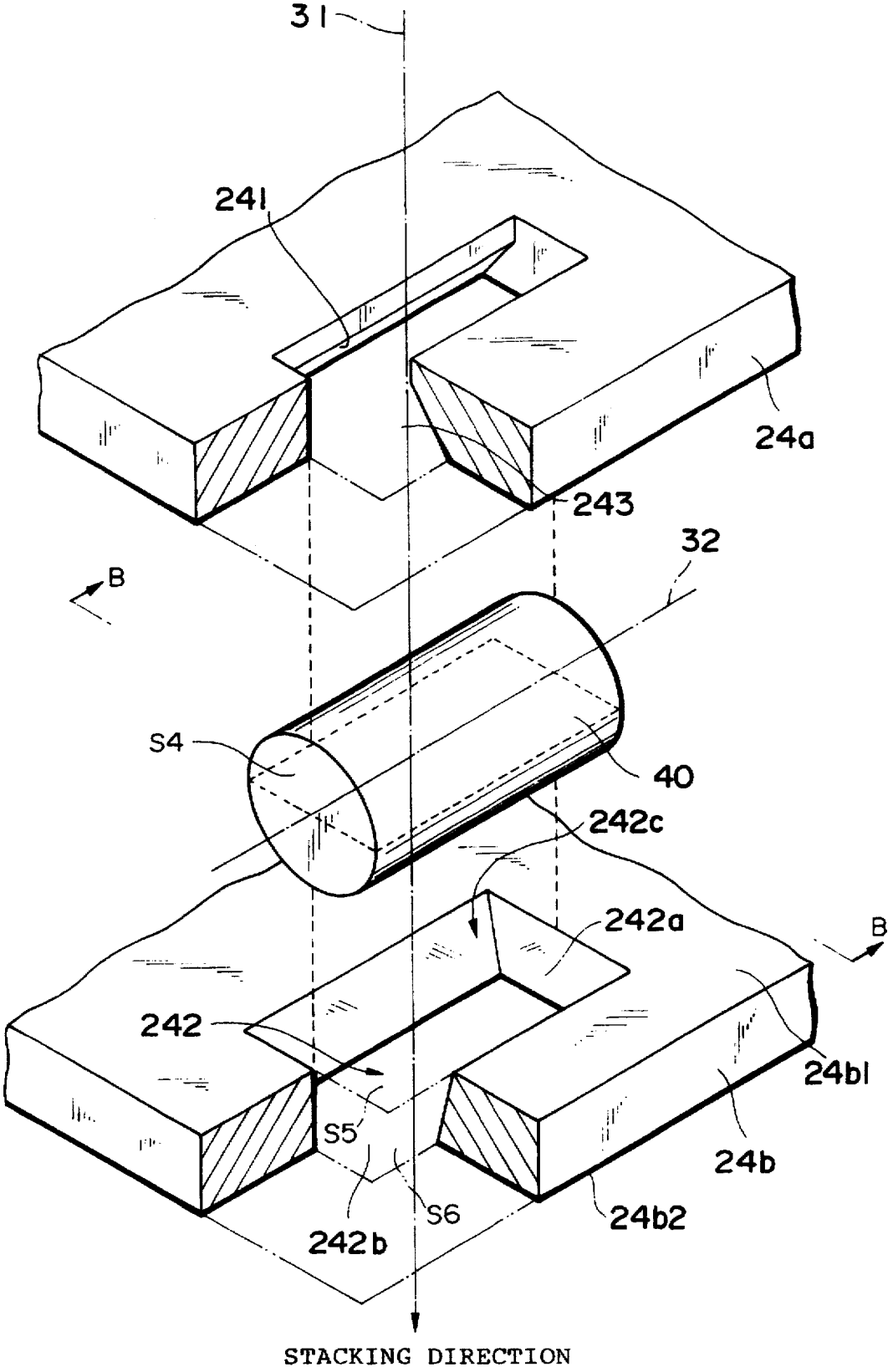
FIG. 17 is a perspective view showing the holding structure of a circularly cylindrical insulator of a dynode plate.

As shown in FIG. 2, each dynode plate 24 is constituted by an upper-electrode plate 24*a* and a lower-electrode plate 24*b* which is in tight contact with and electrically connected to the upper-electrode plate 24*a* and grips the insulators 27 together with the upper-electrode plate 24*a*. FIG. 2 shows a case wherein the insulators 27 are spherical. FIG. 17 shows a case wherein the insulators 27 are circular cylinders.

The upper-electrode plate 24*a* has a first through hole 241 formed with a tapered portion 243 at its first upper-electrode surface $24a_1$ which is in tight contact with the lower-electrode plate 24*b*. The first through hole 241 aligns the insulator 27 gripped by the another dynode plate (the photocathode side of the hole 241) and couples a second upper-electrode surface $24a_2$ (of the upper-electrode plate 24*a*) on the opposite side to the first upper-electrode surface $24a_1$ with the tapered portion 243. The lower-electrode plate 24*b* has a second through hole 242. The second through hole 242 couples a first lower-electrode surface $24b_1$ which is in tight contact with the first upper-electrode surface of the upper-electrode plate 24*a*) with a second lower-electrode surface $24b_2$ on the opposite side to the first lower-electrode surface $24b_1$, and grips the insulator 27. An area S2 of an opening 242*a* of the second through hole 242 located on the first lower-electrode surface side of the second through hole 242 is larger than an area S3 of an opening 242*b* of the second through hole 242 located on the second lower-electrode surface side of the second through hole 242.

In particular, the area S2 of the opening 242*a* of the second through hole 242 on the first lower-electrode surface side is larger than a maximum area S1 of the section of the insulator 27, the section being in parallel to the major surface 251 of the anode plate 25. On the other hand, the area S3 of the opening 242*b* of the second through hole 242 located on the second lower-electrode surface side is smaller than the maximum area S1 of the section of the insulator 27, the section being in parallel to the major surface 251 of the anode plate 25.

When each insulator 27 is spherical, as shown in FIG. 2, its section having the maximum area is a section including its center 270. When each insulator 27 is a circular cylinder, as shown in FIG. 17, its section having the maximum area is a section including its central axis 32. The central axis 32 of the circularly cylindrical insulator 27 is perpendicular to a direction (the stacking direction 31 of the dynode plates 24) perpendicular to the major surface 251 of the anode plate 25. In other words, the center axis 32 is in parallel to the major surface 251 of the anode plate 25.

Thus, an inner wall 242*c* of the second through hole 242 is brought into contact with the corresponding insulator 27, and part of this insulator 27 projects from the opening 242*b* of the second through hole located on the second lower-electrode surface $24b_2$. When this insulator 27 is held by the upper- and lower-electrode plates 24*a* and 24*b*, its center 270 (or the central axis 32 if the insulator 27 is a circular cylinder) is located between the first and second lower-electrode surfaces $24b_1$ and $24b_2$ of the lower-electrode plate 24*b*, i.e., in a gap T shown in FIG. 4. The gap T corresponds to the thickness of the lower-electrode plate 24*b*.

The dynode unit 20 is obtained by stacking the dynode plates 24 each constituted by the upper- and lower-electrode plates 24*a* and 24*b* gripping the associated insulator 27 and tightly fixed with each other in the above manner. When the dynode plates 24 are stacked, the insulators 27 that are adjacent to each other in the direction perpendicular to the major surface 251 of the anode plate 25 are brought into direct contact with each other at points C1. The adjacent insulators 27 are also in contact with the edges (indicated by reference symbols C2 and C3 in FIG. 4) of the first through holes 241 formed in the upper-electrode plates 24*a* (see FIG. 4).

From the above arrangement, the first through holes 241 formed in each upper-electrode plate 24*a* realize alignment of the dynodes 241 supported by a dynode plate 24 located above this dynode plate (on the incident side of the electron flow). Since the insulators 27 adjacent in the direction perpendicular, to the major surface 251 of the anode plate 25 are in contact with each other, the respective insulators 27 transmit a structural pressure applied from the upper side (photocathode side) directly to the lower side anode (plate side). In other words, with this structure, the physical load applied to the dynode plates 24 holding the insulators 27, e.g., the structural pressure that might cause fracture of the dynode plates 24, is decreased furthermore, when the upper- and lower-electrode plates 24*a* and 24*b* are brought into tight contact with each other, each insulator 27 is accommodated in a space defined by a side wall 243*a* of the tapered portion 243 and the inner wall 242*c* of the second through hole 242 as it partly projects from the opening 242*b* of the second through hole 242. Therefore, the insulators 27 held by the upper- and lower-electrode plates 24*a* and 24*b* serve as the spacers that separate the respective dynode plates 24 from each other by a predetermined gap.

Figure 3:
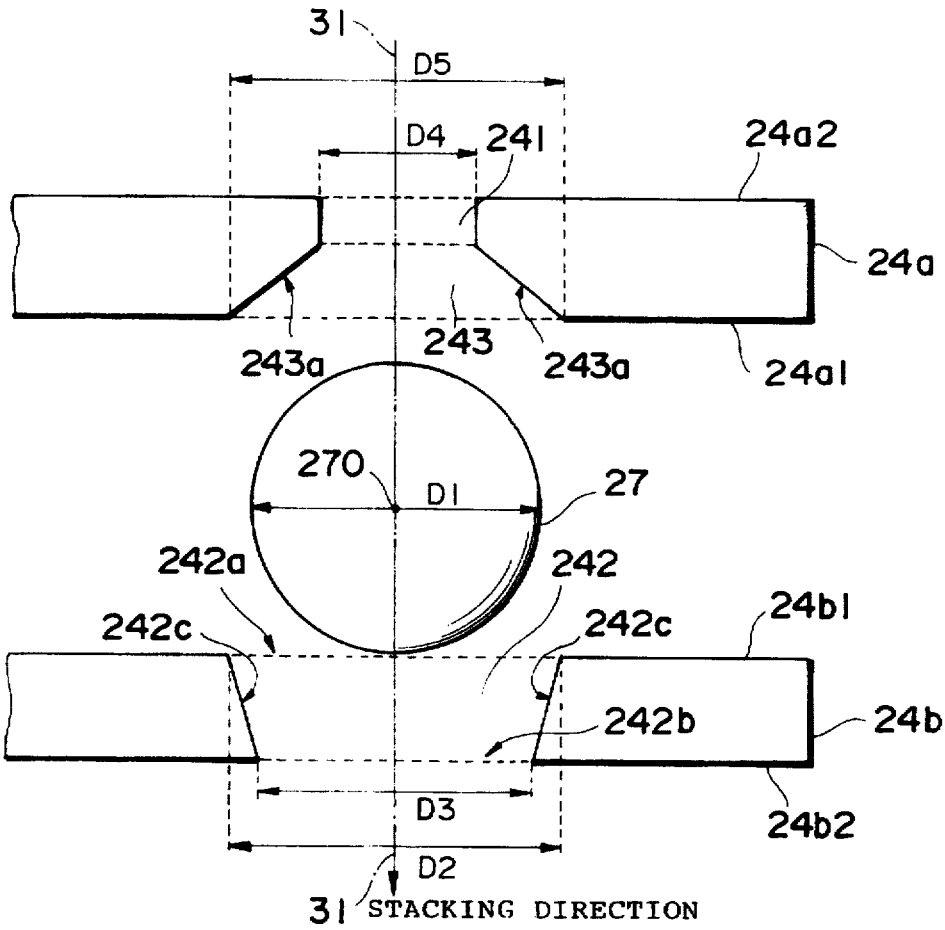
FIGS. 3 and 4 are sectional views showing the holding structure of the insulator of the dynode plate and taken along lines A—A and B—B in FIGS. 2 and 17.
Figure 4:
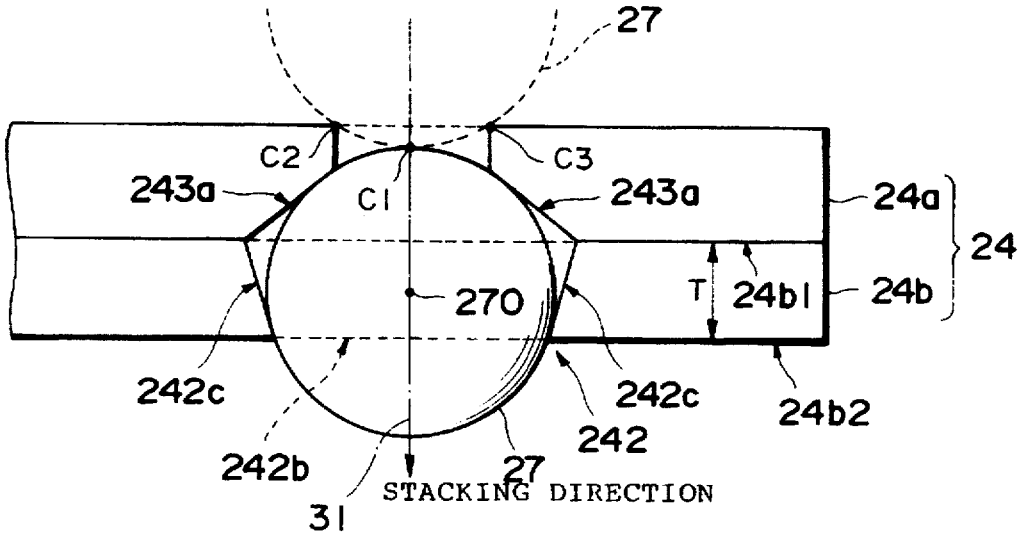

This arrangement will be described in more detail with reference to FIGS. 3 and 4. The sectional views of FIGS. 3 and 4 show the holding structure of the insulator shown in FIG. 2. These sections coincide with the section of the circularly cylindrical insulator of FIG. 17 that shows the holding structure of the circularly cylindrical insulator, which is perpendicular to the central axis 32 of the circular cylinder.

As shown in FIG. 3, the tapered portion 243 having an opening with a diameter D5 is formed in the first upper-electrode surface 24a, of the upper-electrode plate 24a. This tapered portion 243 is communicated with the second upper-electrode surface $24a_2$ by the through hole 241 having a diameter D4. The through hole 242 for coupling the first and second lower-electrode surfaces $24b_1$ and $24b_2$ is formed in the lower-electrode plate 24b. Upper and lower diameters D2 and D3 of the opening 242 and a diameter D1 of the insulators 27 satisfy the following relationship:

$$D3<D1<D2$$

where

D1: the diameter of the spherical insulators 27

D2: the diameter of the opening 242a of the through hole 242 on the first lower-electrode surface side D3: the diameter of the opening 242b of the through hole 242 on the second lower-electrode surface side With the above arrangement, when the upper- and lower-electrode plates 24a and 24b are brought into tight contact with each other, the insulators 27 are held by the side wall 243a of the tapered portion 243 and the inner wall 242c of the through hole 242, as shown in FIG. 4. In FIG. 4, reference symbol C1 denotes a contact point where the insulator held by a given dynode plate 24 and another insulator adjacent to this insulator in the stacking direction 31 are in contact with each other, and C2 and C3 denote contact points where this another insulator and the edge of the through hole 241 formed in the upper-electrode plate 24a are in contact with each other. When the insulator held by the dynode plate 24 located on the upper side (on the photocathode side) is fixed by the through hole (the through hole 241 formed in the upper-electrode plate) of an adjacent lower side dynode plate (on the anode plate side), the dynodes of the respective stages are aligned.

Figure 6:
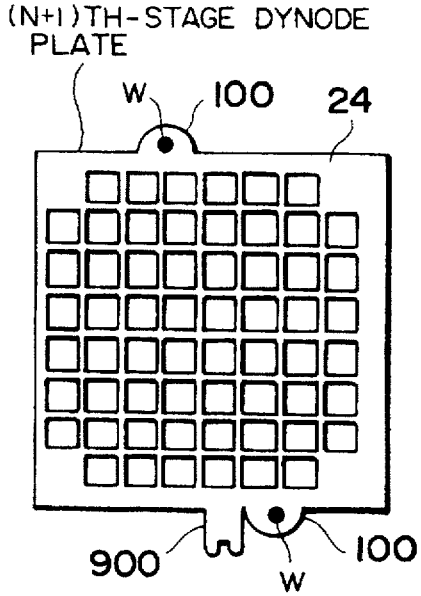
Figure 7:
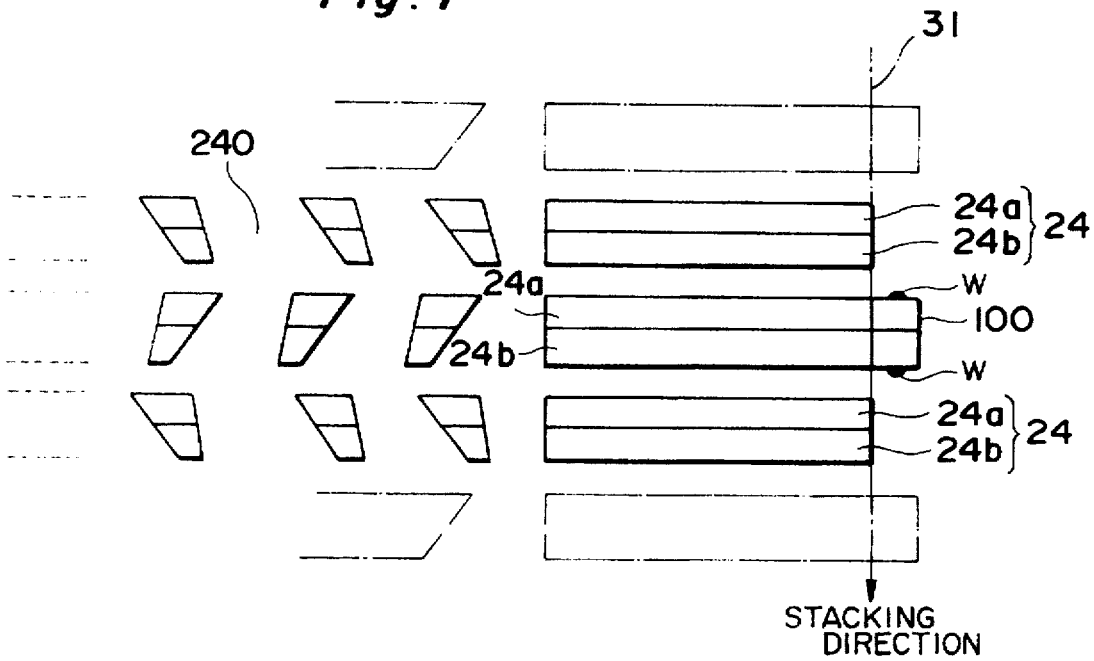
FIG. 7 is a sectional view showing the structure of an electron multiplier obtained by stacking the dynode plates shown in FIGS. 5 and 6.

The structure for bringing the upper- and lower-electrode plates 24a and 24b constituting each dynode plate 24 into tight contact with each other will be described with reference to FIGS. 5 to 7.

Figure 5:
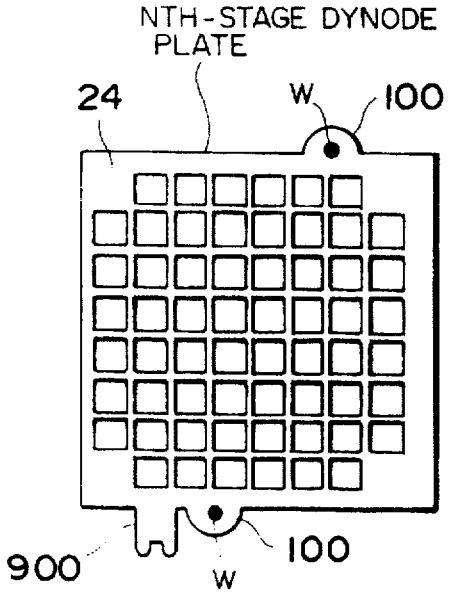
FIGS. 5 and 6 are views for explaining the method of bringing upper- and lower-electrode plates constituting each dynode plate into tight contact with each other.

FIG. 5 shows an nth-stage dynode plate. This metal plate is provided with adhering portions 100 which are predetermined portions around the metal plate and which project in a direction perpendicular to the stacking direction. The upper- and lower-electrode plates 24a and 24b are brought into tight contact with each other and are resistance-welded at the adhering portions 100. In FIG. 5, reference symbols W denote welding portions. FIG. 5 also shows an engaging portion 900 which electrically connects a connection pin 14 (to be described later) to this metal plate. FIG. 6 is a view showing an (n+1)th-stage dynode plate. Adhering portions 100 and an engaging portion 900 are shown in FIG. 6 in the same manner as in FIG. 5. The positions where the adhering portions 100 and the engaging portion 900 are provided differ from one dynode plate to another. In other words, the positions of the adhering portions 100 and the engaging portion 900 are shifted so that the gap among the plates at the welding portions W will not become smaller than the gap at other portions when the dynode plates are stacked as shown in FIG. 7.

The tight contact structure of the upper- and lower-electrode plates 24a and 24b constituting each dynode plate is disclosed in, e.g., U.S. Pat. No. 5,491,380.

Figure 8:
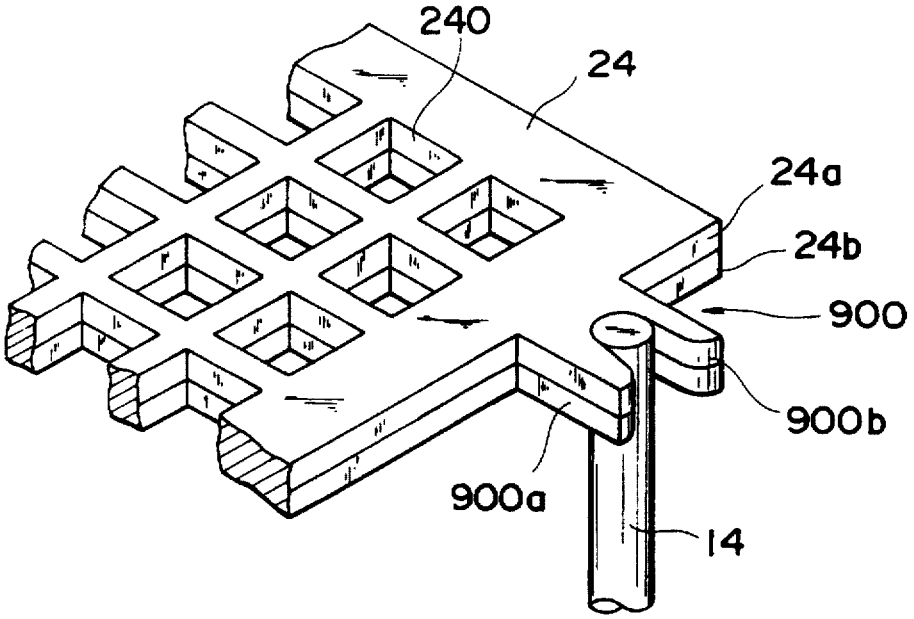
FIG. 8 is a perspective view for explaining the first engaging structure of a dynode plate and a voltage supply pin.
Figure 9:
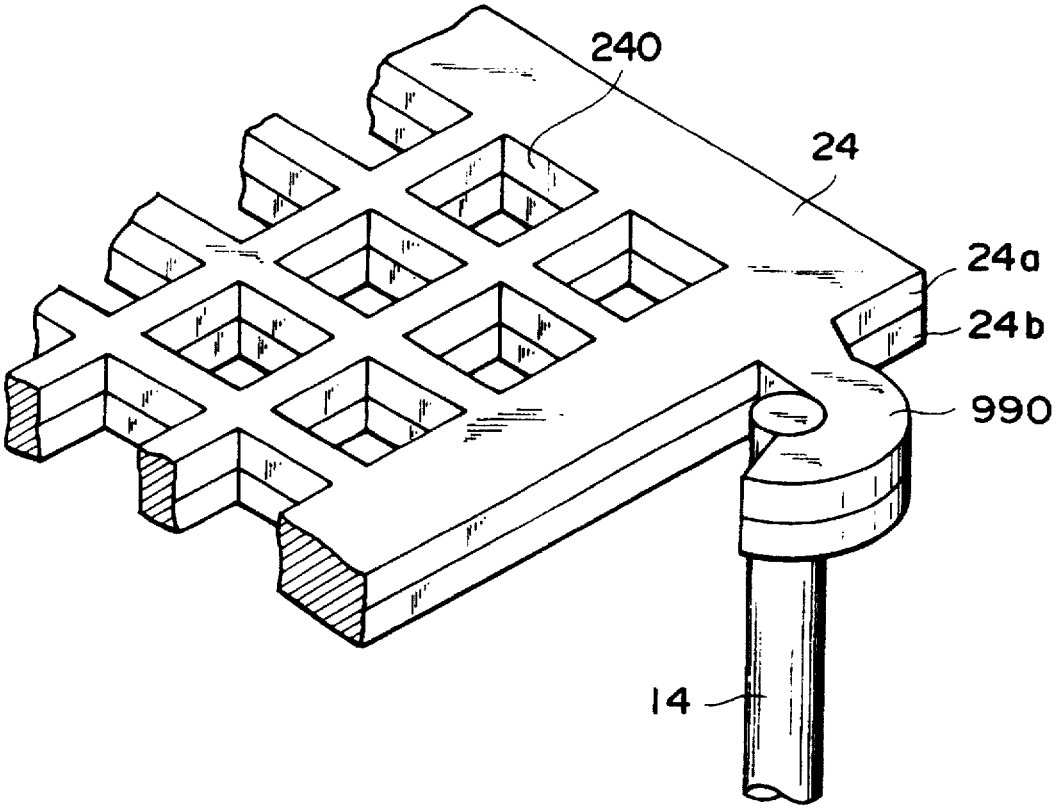
FIG. 9 is a perspective view showing the second engaging structure of a dynode plate and a voltage supply pin.

The arrangement for connecting the connection pins 14 and the dynode plates 24 will be described with reference to FIGS. 8 and 9. FIG. 8 shows the first structure in which the engaging portion 900 for the connection pin 14 is constituted by two projections 900a and 900b. As the second structure, as shown in FIG. 9, a U-shaped projection 990 may serve as the engaging portion, so that the distal end of the connection pin 14 is engaged with the associated dynode plate 24. The structure for engaging the dynode plate with the distal end of the connection pin 14 is disclosed in, e.g. U.S. Pat. No. 5,498,926.

Figure 10:
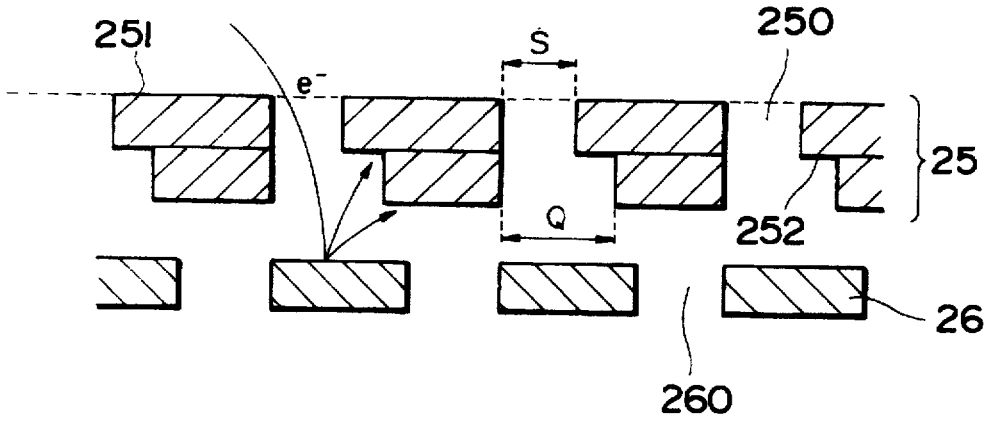
FIG. 10 is a view showing the section of an anode plate.

FIG. 10 shows the section of the anode plate 25. The anode plate 25 is provided between the dynode unit 20 and the last-stage dynode plate 26 and is formed with the plurality of through holes 250. An opening gap S of the openings 250 on the dynode unit 20 side is smaller than an opening gap Q of the openings 250 on the dynode plate 26 side. A surface 251 in parallel to the dynode plate 26 is formed on the inner wall of each opening 250. Since the secondary electrons emitted from the last-stage dynode plate 26 are positively captured by the surface 252, the anode plate 25 can efficiently capture the secondary electrons. The structure of the anode plate 25 is disclosed in, e.g., U.S. patent application Ser. No. 08/234,153.

The structure of the photomultiplier according to the present invention, and in particular, of the electron multiplier, will be described in further detail with reference to FIGS. 11 to 17.

Figure 11:
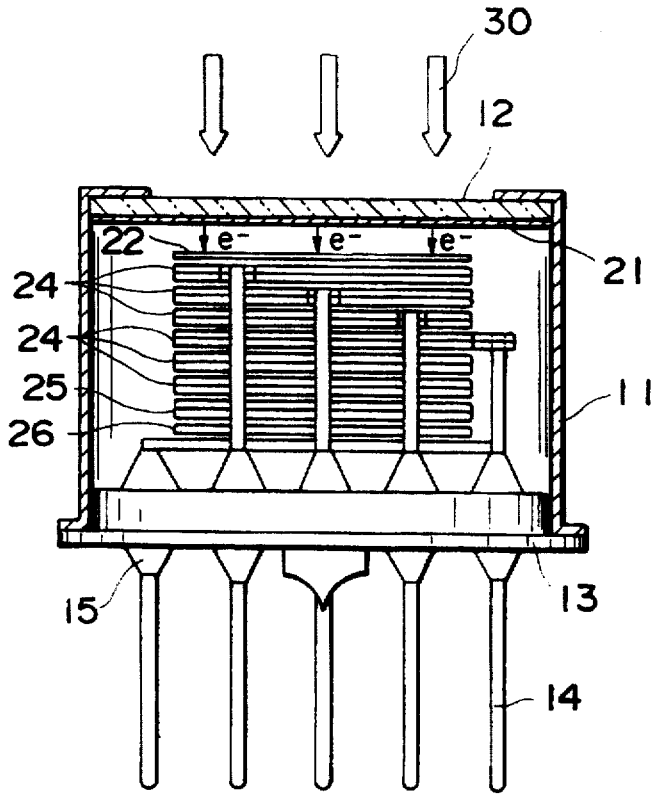
FIG. 11 is a side view showing the structure of an electron multiplier shown in FIG. 1.

Referring to FIG. 11, in the electron multiplier of this embodiment, the dynode unit 20 for multiplying the incident electron flow is disposed in the circularly cylindrical vacuum vessel 10. The vacuum vessel 10 is constituted by the cylindrical metal side tube 11, the circular light-receiving surface plate 12 provided at one end of the metal side tube 11, and the circular stem 13 provided at the other end of the metal side tube 11 and constituting the base portion. The photocathode 21 is provided on the lower surface of the light-receiving surface plate 12, and the focusing electrode plate 22 is disposed between the photocathode 21 and the dynode unit 20.

The dynode unit 20 is constituted by stacking the dynode plates 24 having a large number of electron multiplication holes (dynodes) 240 in a plurality of stages. The anode plate 25 and the last-stage dynode plate 26 are disposed under the stacked dynode plates 24 in this order. The insulator balls 27 made of a ceramic are incorporated into the dynode plates 24 and the anode plate 25.

The stem 13 serving as the base portion is connected to the voltage terminals of the external power supply 200, and a total of 12 stem pins 14 for applying predetermined voltages to the respective dynode plates 24 and 26, and the like extend through the stem 13. Each stem pin 14 is fixed to the stem 13 with a tapered hermetic glass member 15. Each stem pin 14 has a length to reach the dynode plate to be connected, and its distal end is resistance-welded with the connection terminal 900 or 990 of the corresponding dynode plate 24 or 26.

Figure 12:
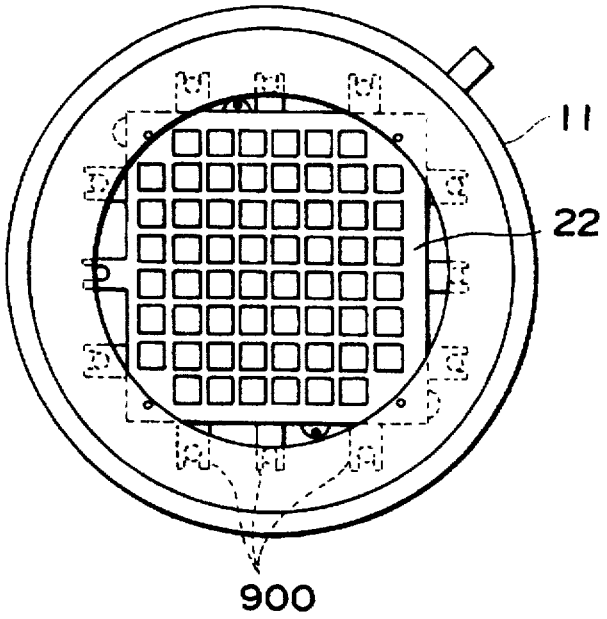
FIG. 12 is a plan view of the photomultiplier according to the present invention.

FIG. 11 is a side view of the electron multiplier according to this embodiment, and FIG. 12 is a plan view of the electron multiplier of this embodiment. Light 30 incident on the light-receiving surface plate 12 excites electrons in the photocathode 21 on the lower surface of the light-receiving surface plate 12 to emit photoelectrons in a vacuum. The photoelectrons emitted from the photocathode 21 are focused on the uppermost-stage dynode plate 24 by the grid-type focusing electrode plate 22 (see FIG. 12) to perform secondary multiplication. The secondary electrons emitted from the dynodes 240 of the uppermost-stage dynode plate 24 are supplied to the dynodes of the lower-stage dynode plates 24 to repeat secondary electron emission. The secondary electron group emitted from the last-stage dynode plate 26 is obtained by the anode plate 25. The obtained secondary electron group is output to the outside through the stem pin 14 connected to the anode plate 25.

Figure 13:
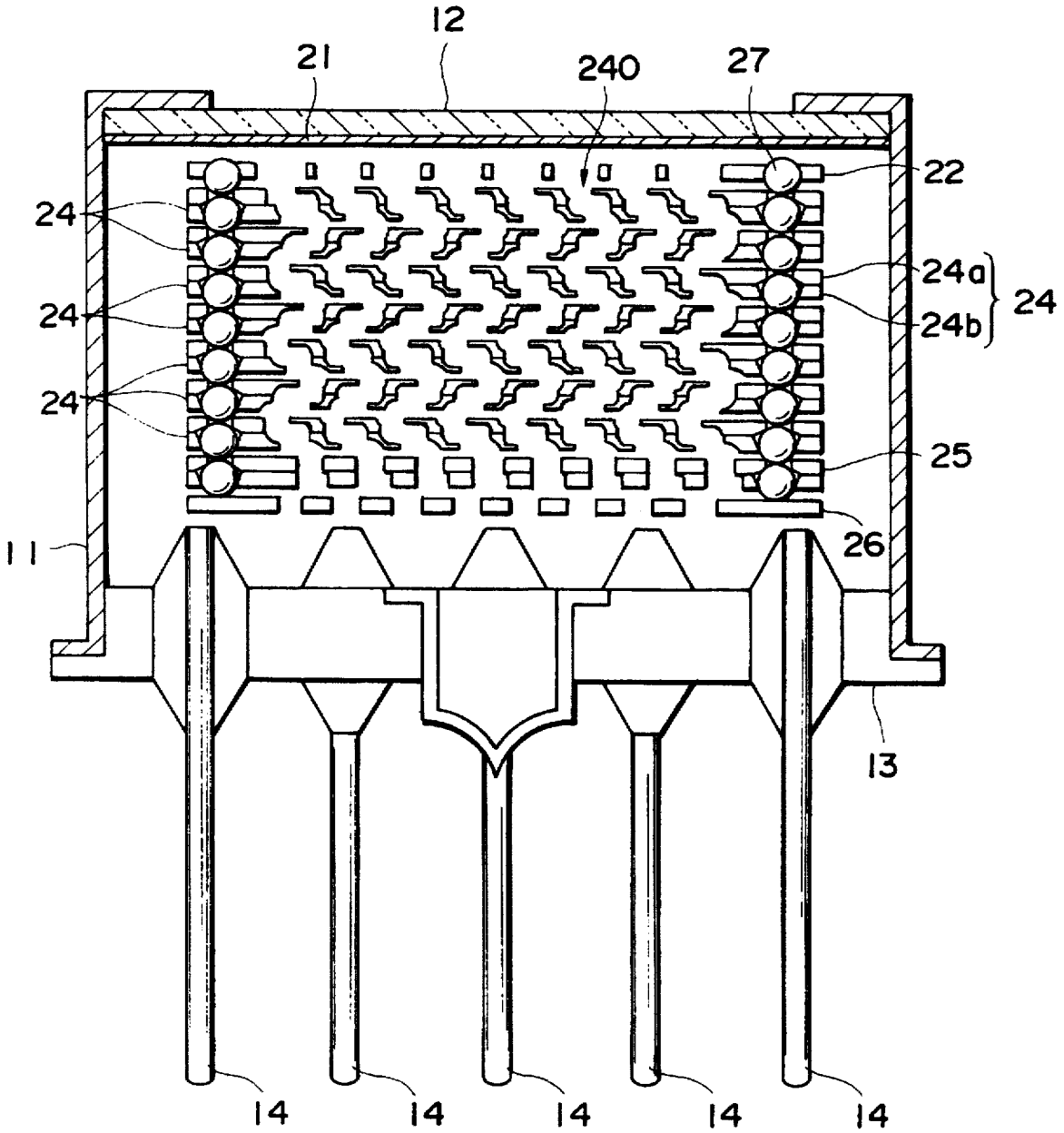
FIG. 13 is a side sectional view of the photomultiplier according to the present invention.

FIG. 13 is a side sectional view of the electron multiplier according to the invention. Referring to FIG. 13, the dynode unit 20 of the electron multiplier is stacked on the anode plate 25 arranged on the last-stage dynode plate 26, and the focusing electrode plate 22 is stacked on the dynode unit 20. The insulator balls 27 are incorporated into the disposing portions at the outer edges of the dynode plates 24 and anode plate 25 (to be referred to as metal plates hereinafter). The predetermined gap among the upper- and lower-stage metal plates is maintained by the projecting portions of the insulator balls 27. A plurality of insulator balls 27 are arranged along the outer edge of each dynode plate 24 and the like, and the insulator balls 27 of the upper and lower stages are in contact with each other. Thus, most of the power applied in the stacking direction 31 of the metal plates is absorbed by the series of insulator balls 27. Even if a power is applied in the stacking direction, no extra force acts on the respective metal plates. Each metal plate is constituted by bonding the upper- and lower-electrode plates **24*a* and 24*b*, and the dynodes 240 having arcuated inner side surfaces are formed in the electrode plates 24*a* and 24*b***.

A technique for constituting the dynode plate from two metal plates is disclosed in, e.g., Japanese Patent Laid-Open No. 60-182642. Electron multiplication holes are formed in each metal plate. The secondary electron emission surfaces **240*a* are formed on the inner walls of these holes, thereby constituting the dynodes 240. The material and the like for forming the secondary electron emission film is disclosed in, e.g., "Surface Analysis of Cu-Be Dynode" (J. Vac. Sci. Technology 17(5), September/October 1980, pp. 1221–1224). The last-stage dynode plate 26 and the anode plate 25 have openings 250 and 260** for passing through gas forming the secondary electron emission surface, respectively.

Figure 14:
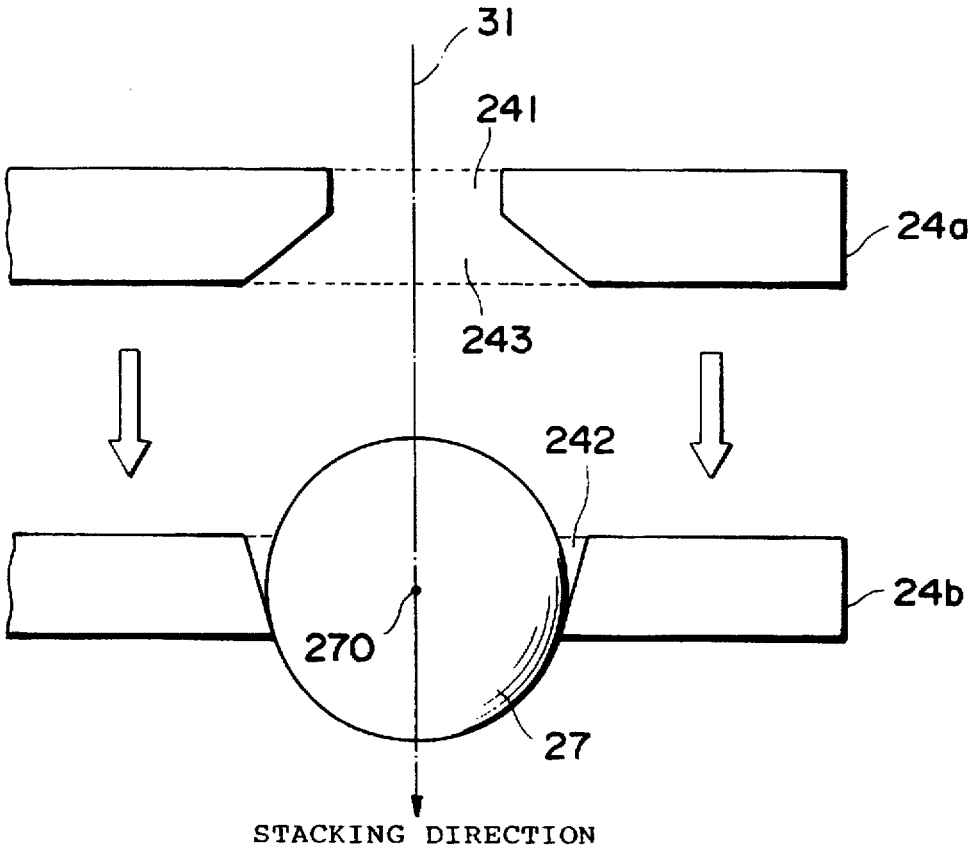
FIG. 14 is a partially cutaway view showing the holding structure of an insulating ball of the dynode plate.
Figure 15:
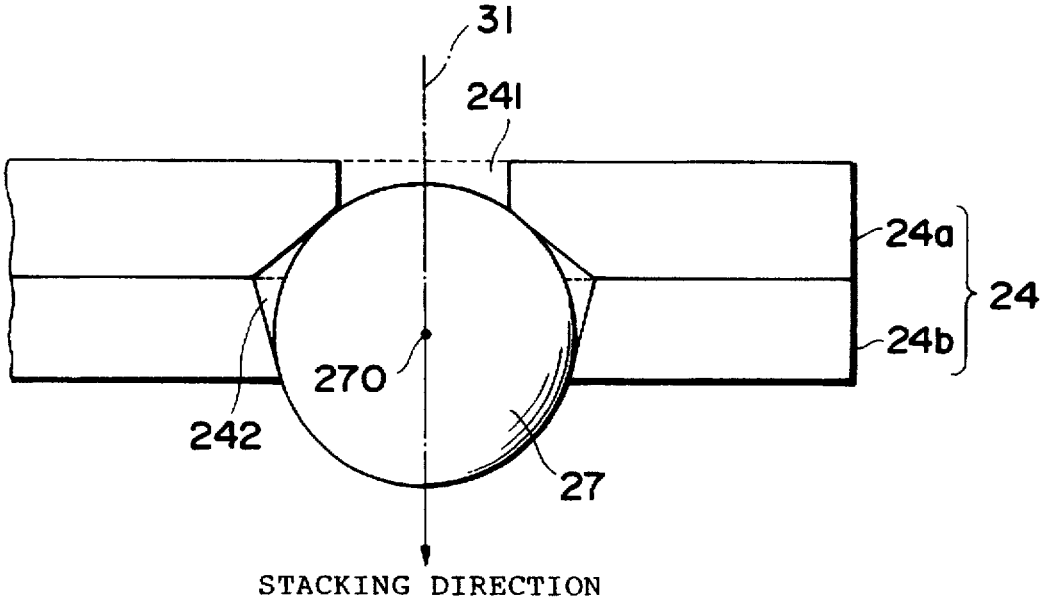
FIG. 15 is a partially cutaway view showing a portion in the dynode plate where the insulating ball is disposed.

FIGS. 14 to 16 are partially cutaway views showing the structure for gripping the insulator balls 27 in the dynode plates 24, which is the characteristic portion of this embodiment. As shown in FIG. 14, the through holes 241 are formed in the upper-electrode plate **24*a* of each dynode plate 24, and the through holes 242 are formed at positions of the lower-electrode plate 24*b* corresponding to the through holes 241. The side wall of the through hole 241 is formed in the tapered manner such that its lower half is widened downward in FIG. 14. The diameter of the upper opening of the through hole 241 is smaller than the diameter of the insulator ball 27, and the diameter of the lower opening of the through hole 241 is larger than the diameter of the insulator ball 27. The side wall of the through hole 242 is formed in the tapered manner such that it is entirely widened upward in FIG. 14. The diameter of the upper opening of the through hole 242 is larger than the diameter of the insulator ball 27, and the diameter of the lower opening of the through hole 242 is smaller than the diameter of the corresponding insulator ball 27. Thus, when the insulator ball 27 is placed in the through hole 242 in the lower-electrode plate 24*b*, the insulator ball 27 is caught by the tapered side wall of the through hole 241, and is held such that about its lower ⅓ projects from the lower opening of the through hole 242**.

Subsequently, as shown in FIG. 15, the through holes 241 and 242 are mated and the upper- and lower-electrode plates **24*a* and 24*b* are bonded. Then, the insulator ball 27 is depressed from obliquely upward by the tapered side wall of the through hole 241, and is completely fixed by the upper- and lower-electrode plates 24*a* and 24*b*. Since the side walls of the through holes 241 and 242 are formed in the tapered manner, automatic alignment is performed along the tapered side walls by only placing the insulator balls 27 in the space surrounded by the through holes 241 and 242, thereby precisely setting the upper- and lower-electrode plates 24*a* and 24*b* to coincide with each other. When the insulator balls 27 are fixed in the through holes 241 and 242, the upper- and lower-electrode plates 24*a* and 24*b* around the insulator balls 27 are resistance-welded, thereby obtaining the dynode plate 24 provided the insulator balls 27 therein. As the dynode plates 24 has this structure, the dynode plates 24 and the insulator balls 27 are integrated with each other. Thus, the insulator balls 27 will not be removed from the dynode plate 24** or drop.

As shown in FIG. 16, the dynode plates 24 into which the insulator balls 27 are incorporated are stacked in a plurality of stages. The stacking operation is adjusted such that part of each insulator ball 27 projecting from the through hole 242 of the dynode plate on the upper stage is partially accommodated in the associated through hole 241 of the dynode plate on the lower stage. When the stacking operation is adjusted in this manner, the centers of the series of insulator balls 27 are located on one straight line 31. The diameters, the sizes of the openings, and the inclined angles of the tapered side walls, respectively, of the through holes 241 and 242 in each of the dynode plate 24 are the same, and thus the sizes (diameters) of the opposing insulator balls 27 are the same. Accordingly, the central axis of the through holes 241 and 242 always coincides with the centers 270 of the insulator balls 27. As a result, the dynode plates 24 and 26 will not be shifted in the horizontal direction, and the stacking gap among them becomes constant. In this embodiment, the insulator balls 27 having a diameter of 0.66 mm are used, and the gap between the dynode plates adjacent in the vertical direction is 0.25 mm. With this arrangement, the dynode plates 24 and 26, the anode plate 25, and the focusing electrode plate 22 can be stacked easily and accurately.

In this embodiment, the insulator balls 27 are used as the insulating spacers. However, the insulating spacers are not limited to the spherical bodies, but can be formed as the insulating circular cylinders 40 as shown in FIG. 17. Even if the insulating spacers are formed as the insulating circular cylinders 40, the same operation and effect as those of the above embodiment can be obtained. In this case, through holes 241 and 242 of opposing dynode plates 24 and the like may be formed at appropriate positions to have a shape (a V-groove shape) so that they extend along the side surfaces of the circular cylinder 40.

In the embodiment shown in FIG. 17, the section of the circular cylinder 40 perpendicular to its central axis 32 coincides with the section shown in FIGS. 3 and 4.

This embodiment is exemplified by a photomultiplier having the photocathode 21. However, a focusing electrode plate 22, an anode plate 25, and a dynode unit 20 may be disposed in an electron multiplier having no photocathode 21, as a matter of course.

In this embodiment, through holes are formed in the dynode plates. However, through holes may be formed in support plates supporting the dynodes, e.g., the support plates shown in U.S. Pat. No. 3,229,143.

As has been described above in detail, according to the electron multiplier of the present invention, since the spherical or circularly cylindrical spacers are fixed by sandwiching them with the upper- and lower-electrode plates of the dynode plates, when stacking the plurality of dynode plates, the spacers will not be shifted. Thus, the gap among the respective stages can be maintained at the predetermined value, so that variations in gain caused by the non-uniformity in the gap of the dynodes are decreased. In particular, when the plurality of dynode plates are stacked as in the conventional case, since the spacers need not be arranged on the dynode plates, the manufacture can be facilitated.

When the dynode plates are stacked, the centers of the respective spherical bodies or the central axes of the respective circular cylinders coincide with the centers of the through holes in the stacking direction. Thus, positional shifts of the dynode plates in the horizontal direction can be prevented, thereby decreasing variations in gain.

Furthermore, when the spacers adjacent to each other in the stacking direction are abutted against each other, even if a power in the stacking direction is applied to the spacers, most of the power acts on the series of spacers, so that the dynode plates will not be deformed. Accordingly, the gap among the dynode plates of the respective stages can be maintained at the predetermined value.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An electron multiplier comprising:

an anode plate supporting at least one anode; and a dynode unit having a plurality of dynode plates stacked in a direction perpendicular to a major surface of said anode plate through insulators so as to be separated from each other by a predetermined interval, each of said dynode plates supporting at least one dynode and having:

an upper-electrode plate; and a lower-electrode plate which is in tight contact with and is electrically connected to said upper-electrode plate, and holds said insulators together with said upper-electrode plate.

2. A multiplier according to claim 1, wherein each of said insulators held by said upper- and lower-electrode plates is in direct contact with another insulator of said insulators, that is adjacent in the direction perpendicular to said major surface of said anode plate.

3. A multiplier according to claim 1, wherein said upper-electrode plate has a first through hole, having a tapered portion at a first upper-electrode surface that is of said upper-electrode plate and is in tight contact with a first lower-electrode surface of said lower-electrode plate, for coupling a second upper-electrode surface of said upper-electrode plate on an opposite side of said first upper-electrode surface to said tapered portion, said lower-electrode plate has a second through hole for causing said first lower-electrode surface to communicate with a second lower-electrode surface on an opposite side of said first lower-electrode surface, and said tapered portion of said first through hole and said second through hole define a space for partially accommodating one of said insulators.

4. A multiplier according to claim 3, wherein the opening area of said second through hole on said first lower-electrode surface side is larger than a maximum area of a section of each of said insulators, said section being in parallel to said major surface of said anode plate.

5. A multiplier according to claim 3, wherein the opening area of said second through hole on said second lower-electrode surface side is smaller than a maximum area of a section of each of said insulators, said section being in parallel to said major surface of said anode plate.

6. A multiplier according to claim 3, wherein each of said insulators gripped by said upper- and lower-electrode plates partly projects from said second lower-electrode surface of said lower-electrode plate.

7. A multiplier according to claim 1, wherein each of said insulators is one of a spherical body and a circular cylinder.

8. An electron multiplier comprising:

an anode plate supporting at least one anode; and a dynode unit having a plurality of dynode plates stacked in a direction perpendicular to a major surface of said anode plate through insulators so as to be separated from each other by a predetermined interval, each of said dynode plates supporting at least one dynode and having:

an upper-electrode plate; and a lower-electrode plate which is in tight contact with and is electrically connected to said upper-electrode plate, and holds said insulators together with said upper-electrode plate, wherein said upper-electrode plate has a first through hole, having a tapered portion at a first upper-electrode surface that is of said upper-electrode plate and is in tight contact with a first lower-electrode surface of said lower-electrode plate, for coupling a second upper-electrode surface of said upper-electrode plate on an opposite side of said first upper-electrode surface to said tapered portion, said lower-electrode plate has a second through hole for causing said first lower-electrode surface to communicate with a second lower-electrode surface on an opposite side of said first lower-electrode surface, and said tapered portion of said first through hole and said second through hole define a space for partially accommodating one of said insulators.

9. A multiplier according to claim 8, wherein each of said insulators held by said upper- and lower-electrode plates is in contact with another insulator of said insulators, that is adjacent in the direction perpendicular to said major surface of said anode plate.

10. A multiplier according to claim 8, wherein the opening area of said second through hole on said first lower-electrode surface side is larger than a maximum area of a section of each of said insulators, said section being in parallel to said major surface of said anode plate.

11. A multiplier according to claim 8, wherein the opening area of said second through hole on said second lower-electrode surface side is smaller than a maximum area of a section of each of said insulators, said section being in parallel to said major surface of said anode plate.

12. A multiplier according to claim 8, wherein each of said insulators gripped by said upper- and lower-electrode plates partly projects from said second lower-electrode surface of said lower-electrode plate.

13. A multiplier according to claim 8, wherein each of said insulators is one of a spherical body and a circular cylinder.

14. A multiplier according to claim 8, wherein a center of said each insulator is located between said first and second lower-electrode surfaces of said lower-electrode plate.

15. A photomultiplier comprising:

a photocathode;

an anode plate supporting at least one anode; and a dynode unit provided between said photocathode and said anode plate and having a plurality of dynode plates stacked in a direction perpendicular to a major surface of said anode plate through insulators so as to be separated from each other by a predetermined interval, each of said dynode plates supporting at least one dynode and having:

an upper-electrode plate; and a lower-electrode plate which is in tight contact with and is electrically connected to said upper-electrode plate, and holds said insulators together with said upper-electrode plate.

16. A photomultiplier according to claim 15, wherein each of said insulators held by said upper- and lower-electrode plates is in contact with another insulator of said insulators, that is adjacent in the direction perpendicular to said major surface of said anode plate.

17. A photomultiplier according to claim 15, wherein said upper-electrode plate has a first through hole, having a tapered portion at a first upper-electrode surface that is of said upper-electrode plate and is in tight contact with a first lower-electrode surface of said lower-electrode plate, for coupling a second upper-electrode surface of said upper-electrode plate on an opposite side of said first upper-electrode surface to said tapered portion, said lower-electrode plate has a second through hole for causing said first lower-electrode surface to communicate with a second lower-electrode surface on an opposite side of said first lower-electrode surface, and said tapered portion of said first through hole and said second through hole define a space for partially accommodating one of said insulators.

18. A photomultiplier according to claim 17, wherein the opening area of said second through hole on said first lower-electrode surface side is larger than a maximum area of a section of each of said insulators, said section being in parallel to said major surface of said anode plate.

19. A photomultiplier according to claim 17, wherein the opening area of said second through hole on said second lower-electrode surface side is smaller than a maximum area of a section of each of said insulators, said section being in parallel to said major surface of said anode plate.

20. A photomultiplier according to claim 17, wherein each of said insulators gripped by said upper- and lower-electrode plates partly projects from said second lower-electrode surface of said lower-electrode plate.

21. A photomultiplier according to claim 15, wherein each of said insulators is one of a spherical body and a circular cylinder.

22. A photomultiplier comprising:

a photocathode;

an anode plate supporting at least one anode; and a dynode unit provided between said photocathode and said anode plate and having a plurality of dynode plates stacked in a direction perpendicular to a major surface of said anode plate through insulators so as to be separated from each other by a predetermined interval, each of said dynode plates supporting at least one dynode and having:

an upper-electrode plate; and a lower-electrode plate which is in tight contact with and is electrically connected to said upper-electrode plate, and holds said insulators together with said upper-electrode plate, wherein said upper-electrode plate has a first through hole, having a tapered portion at a first upper-electrode surface that is of said upper-electrode plate and is in tight contact with a first lower-electrode surface of said lower-electrode plate, for coupling a second upper-electrode surface of said upper-electrode plate on an opposite side of said first upper-electrode surface to said tapered portion, said lower-electrode plate has a second through hole for causing said first lower-electrode surface to communicate with a second lower-electrode surface on an opposite side of said first lower-electrode surface, and said tapered portion of said first through hole and said second through hole define a space for partially accommodating one of said insulators.

23. A photomultiplier according to claim 22, wherein each of said insulators held by said upper and lower-electrode plates is in contact with another insulator of said insulators, that is adjacent in the direction perpendicular to said major surface of said anode plate.

24. A photomultiplier according to claim 22, wherein the opening area of said second through hole on said first lower-electrode surface side is larger than a maximum area of a section of each of said insulator, said section being in parallel to said major surface of said anode plate.

25. A photomultiplier according to claim 22, wherein the opening area of said second through hole on said second lower-electrode surface side is smaller than a maximum area of a section of each of said insulators, said section being in parallel to said major surface of said anode plate.

26. A photomultiplier according to claim 22, wherein each of said insulators gripped by said upper- and lower-electrode plates partly project from said second lower-electrode surface of said lower-electrode plate.

27. A photomultiplier according to claim 22, wherein each of said insulators is one of a spherical body and a circular cylinder.

28. A photomultiplier according to claim 22, wherein a center of each of said insulators is located between said first and second lower-electrode surfaces of said lower-electrode plate.

* * * * *